US012303049B2

(12) United States Patent
Miksovsky et al.

(10) Patent No.: US 12,303,049 B2
(45) Date of Patent: May 20, 2025

(54) STRAW

(71) Applicant: humangear, Inc., San Francisco, CA (US)

(72) Inventors: Christopher A. Miksovsky, Bend, OR (US); Scott D. Cook, Oakland, CA (US)

(73) Assignee: humangear, inc., San Francisco, CA (US)

( * ) Notice: Subject to any disclaimer, the term of this patent is extended or adjusted under 35 U.S.C. 154(b) by 580 days.

(21) Appl. No.: 17/549,700

(22) Filed: Dec. 13, 2021

(65) Prior Publication Data

US 2022/0183487 A1 Jun. 16, 2022

Related U.S. Application Data

(60) Provisional application No. 63/125,861, filed on Dec. 15, 2020.

(51) Int. Cl.
*A47G 21/18* (2006.01)

(52) U.S. Cl.
CPC ..... *A47G 21/18* (2013.01)

(58) Field of Classification Search
CPC .... A47G 21/18; A47G 19/2266; B65D 77/24; B65D 77/28
USPC ..... 239/33
See application file for complete search history.

(56) References Cited

U.S. PATENT DOCUMENTS 256,060 A 4/1882 Seagrave
3,025,004 A * 3/1962 Levi ..... B31F 1/205 239/33
6,431,216 B1 * 8/2002 Briscoe ..... F16L 57/00 138/110
9,988,177 B1 * 6/2018 Ruprecht ..... B65D 11/04
10,123,641 B1 * 11/2018 Pepper ..... B08B 1/165
2018/0352983 A1 * 12/2018 Allen ..... A47G 21/18
2019/0038058 A1 * 2/2019 Abbott-Glazier ..... A47G 21/18
2020/0010250 A1 * 1/2020 Herling ..... B65D 77/283
2020/0138216 A1 * 5/2020 Phan ..... A47G 21/18
2020/0214485 A1 * 7/2020 Ng ..... A47G 21/18
(Continued)

FOREIGN PATENT DOCUMENTS

KR 20210000658 U * 3/2021 ..... A47G 21/18
WO WO-2016200172 A1 * 12/2016 ..... A47G 21/18
(Continued)

OTHER PUBLICATIONS

"Icicle Straw—The World's First Splittable Drinking Straw", Internet Archive page dated Jul. 7, 2019 (downloaded on Jan. 3, 2022), https://web.archive.org/web/20190707082752/https://www.kickstarter.com/projects/miim/icicle-straw-the-worlds-cleanest-reusable-drinking.

(Continued)

*Primary Examiner* — Arthur O. Hall
*Assistant Examiner* — Anna Thi Ho
(74) *Attorney, Agent, or Firm* — Beyer Law Group LLP

(57) ABSTRACT

A straw composed of first and second straw body elements that are pivotally coupled at a first longitudinal end of the straw is described. The straw body elements can be pivoted between a stable drinking position in which a longitudinally sealed channel is formed between the straw body elements, and a splayed position suitable for washing internal channel wall portions of the straw body elements.

17 Claims, 22 Drawing Sheets

(56) References Cited

U.S. PATENT DOCUMENTS

| | | | | |
|---|---|---|---|---|
| 2020/0253404 | A1* | 8/2020 | Cohen | A47L 17/00 |
| 2021/0219759 | A1* | 7/2021 | Gunn | A47G 21/18 |
| 2022/0031102 | A1* | 2/2022 | Jeon | A47G 21/18 |
| 2022/0167770 | A1* | 6/2022 | Li | A47G 21/18 |

FOREIGN PATENT DOCUMENTS

| | | | | |
|---|---|---|---|---|
| WO | WO-2020067147 | A1 * | 4/2020 | |
| WO | 2020/102121 | | 5/2020 | |
| WO | WO-2020093920 | A1 * | 5/2020 | A47G 21/18 |
| WO | WO-2020102121 | A1 * | 5/2020 | A47G 21/18 |
| WO | WO-2020182097 | A1 * | 9/2020 | A47G 21/18 |
| WO | WO-2020230967 | A1 * | 11/2020 | A47G 21/18 |

OTHER PUBLICATIONS

"The Last Straw", Deconstruct-able Straws, webpage and instructional video screenshots, https://www.itsthelaststraw.com/, downloaded on Jan. 3, 2022. It's believed that this, or substantially similar information was available before the priority date of the present application.

"Rain Straw: The Reusable Slide-Apart Straw for Easy Cleaning", Internet Archive Page dated Jul. 7, 2019 (downloaded on Jan. 3, 2022), https://web.archive.org/web/20190707073305/https://www.kickstarter.com/projects/snappower/rain-straw-the-reusable-slide-apart-straw-for-easy.

* cited by examiner

STRAW

CROSS-REFERENCE TO RELATED APPLICATIONS

The present application claims the priority of U.S. Provisional Patent Application No. 63/125,861 filed Dec. 15, 2020, which is incorporated herein by reference in its entirety.

FIELD

The present disclosure relates to reusable drinking straws.

BACKGROUND

Many beverage venders provide straws with their products due to the conveniences provided by drinking through a straw. Most drinking straws used today are disposable products made from plastic. Thus, they are frequently discarded after a single use. Plastic straws tend to take a long time to decompose and accordingly, there has been concern about the environmental impacts of discarded plastic drinking straws. These concerns are significant enough that some cities have banned the use or sale of disposable plastic straws.

These environmental concerns have led to increased use and development of reusable straws. Reusable straws are typically formed from metal or plastic and tend to be more robust than disposable straws. One of the practical problems associated with most reusable drinking straws is that they tend to be difficult to wash. Recently, a few reusable drinking straws have been proposed that are divided into two semicircular, longitudinally extending halves that can be split and rejoined together. One such straw is described in U.S. Patent Publication No. 2018/0352983. Although such straws are more readily washable, they tend to be difficult for some to reassemble. The drawbacks associated with reusable drinking straws has limited their acceptance in the marketplace. In view of the foregoing, there are continuing efforts to develop improved straws having characteristics likely to broaden the adoption and use of reusable straws.

SUMMARY

To achieve the foregoing and other objects of the invention a variety of improved straw designs are described. In one aspect, a pair of longitudinally extending straw body elements are provided. The first (base) straw body element preferably includes an arcuate wall that defines a longitudinally extending channel. The extending second (insert) straw body element has an arcuate outer wall portion and a pair of resilient wings. The wings are configured to extend into the channel when the straw is in an assembled position and a seal is formed between the straw body elements when the straw is in the assembled position. A hinge pivotally couples the base straw body element to the insert straw body element at a first longitudinal end of the of the straw such that the straw body elements can be pivoted between the assembled position in which the straw may be used for drinking, and a splayed position that facilitates washing the straw body elements.

In some embodiments, the hinge is releasable such that the first straw body element can be separated from the second straw body element.

In some embodiments, a catch element is provided that is capable of holding the straw body elements in a stable intermediate splayed position. The stable intermediate splayed position is a position that is between the assembled (drinking) position and a full rotational extent to which the straw body elements can be rotated relative to one another.

In some embodiments, the hinge includes a knuckle integrally formed with the first straw body element at a proximal end of the first straw body element, and a pair of hinge pins integrally formed with the second straw body element at a proximal end of the second straw body element.

In some embodiments, the second straw body element further comprises a pair of stanchions integrally formed with the second straw body element at the proximal end of the second straw body element, each stanchion carrying an associated one of the hinge pins. In some embodiments, the hinge pins are substantially frusto-conical in shape.

In some embodiments, the hinge and stanchions are configured to cause the hinge pins to be ejected from the knuckle when the straw body elements are pivotally rotated sufficiently relative to one another about the hinge's axis of rotation.

In some embodiments, the hinge is configured to permit at least approximately 180 degrees of pivotal rotation or at least approximately 200 degrees of pivotal rotation between the straw body elements.

In some embodiments the seal is formed between the wings and free edges of the first straw body element wall. In selected embodiments, enlarged lips are formed on free edges of the first straw body element wall, exterior troughs are formed at bases of the second straw body element wings, and the seal is formed between complementary portions of the lips and the exterior troughs.

In some embodiments, the lips extend along at least a portion of a proximal end of the first straw body element adjacent the hinge and the troughs extend along at least a portion of a proximal end of the second straw body element adjacent the hinge. With this arrangement, the seal extends along at least a portion of the proximal end of the first and second straw body elements between corresponding portions of the lips and troughs.

In some embodiments, the first straw body element has a substantially C-shaped cross section having an arc length of at least 200 degrees. In selected embodiments the arc length is in the range of approximately 210 to 300 degrees.

In another aspect, a straw includes first and second longitudinally extending straw body elements configured to be joined together in a sealed configuration to facilitate drinking and configured to be at least one of separable or pivoted apart to facilitate washing the straw. A distal end of the second straw body element extends beyond a distal end of the first straw body element to thereby provide a pry engagement surface. The second straw body element also includes a visible target. The target is positioned such that a user can initiate separation of the straw body elements by pulling outward on the pry engagement surface while pushing on the target. In selected embodiments, the target is or includes one of a recess, a protrusion or a marking.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

Figure 1A:
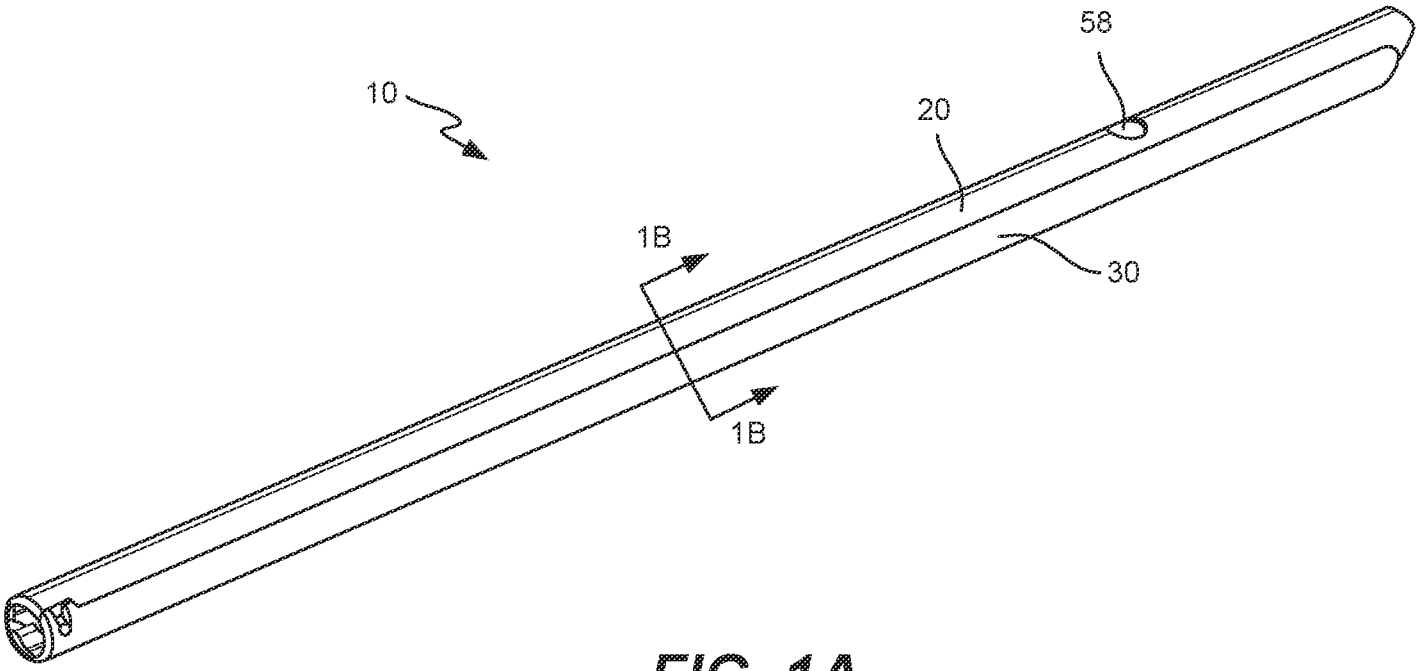
FIG. 1A is a perspective view of a straw in accordance with a described embodiment in the assembled position.
Figure 1B:
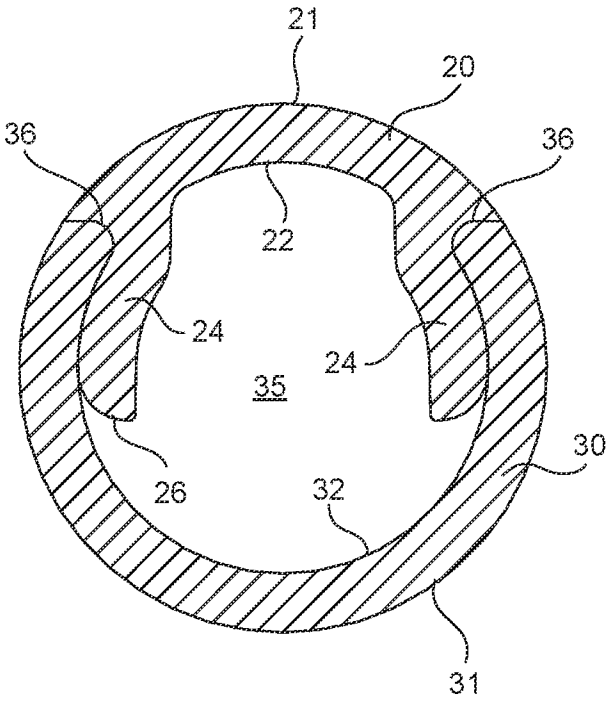
FIG. 1B is a cross sectional view of the straw 10 of FIG. 1A taken along line 1B-1B.
Figure 2:
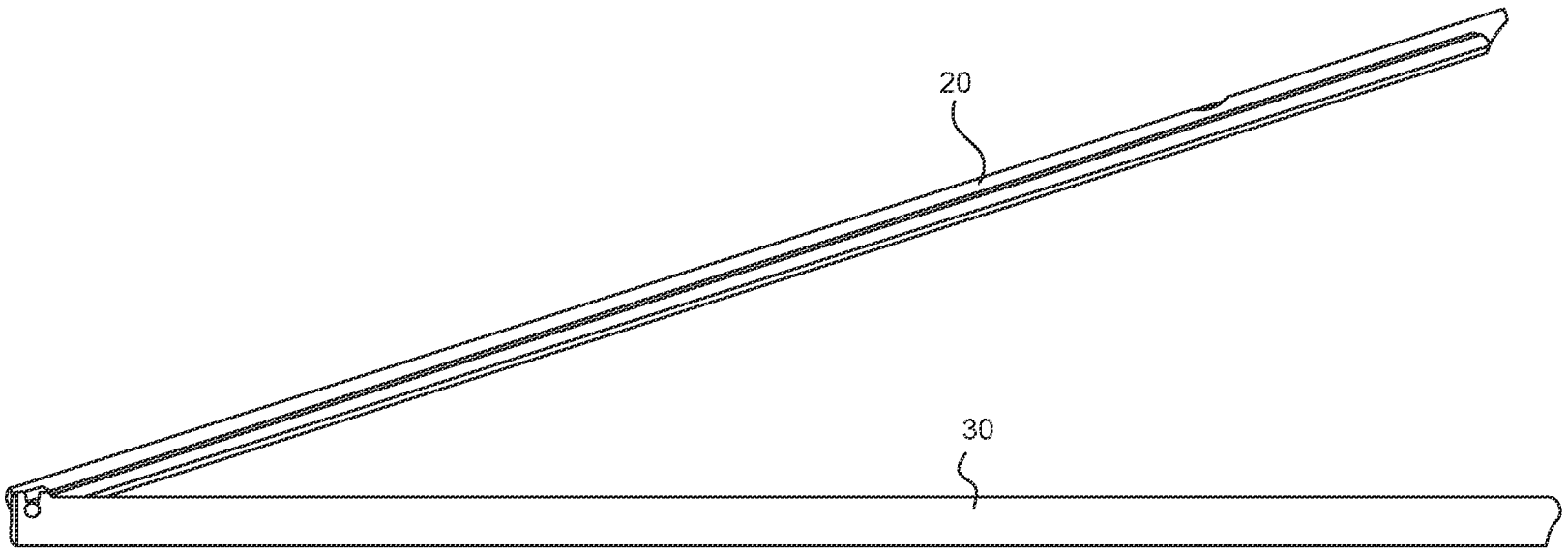
FIG. 2 is a side view of the straw 10 of FIG. 1 with its two halves in a pivoted open position.
Figure 3A:
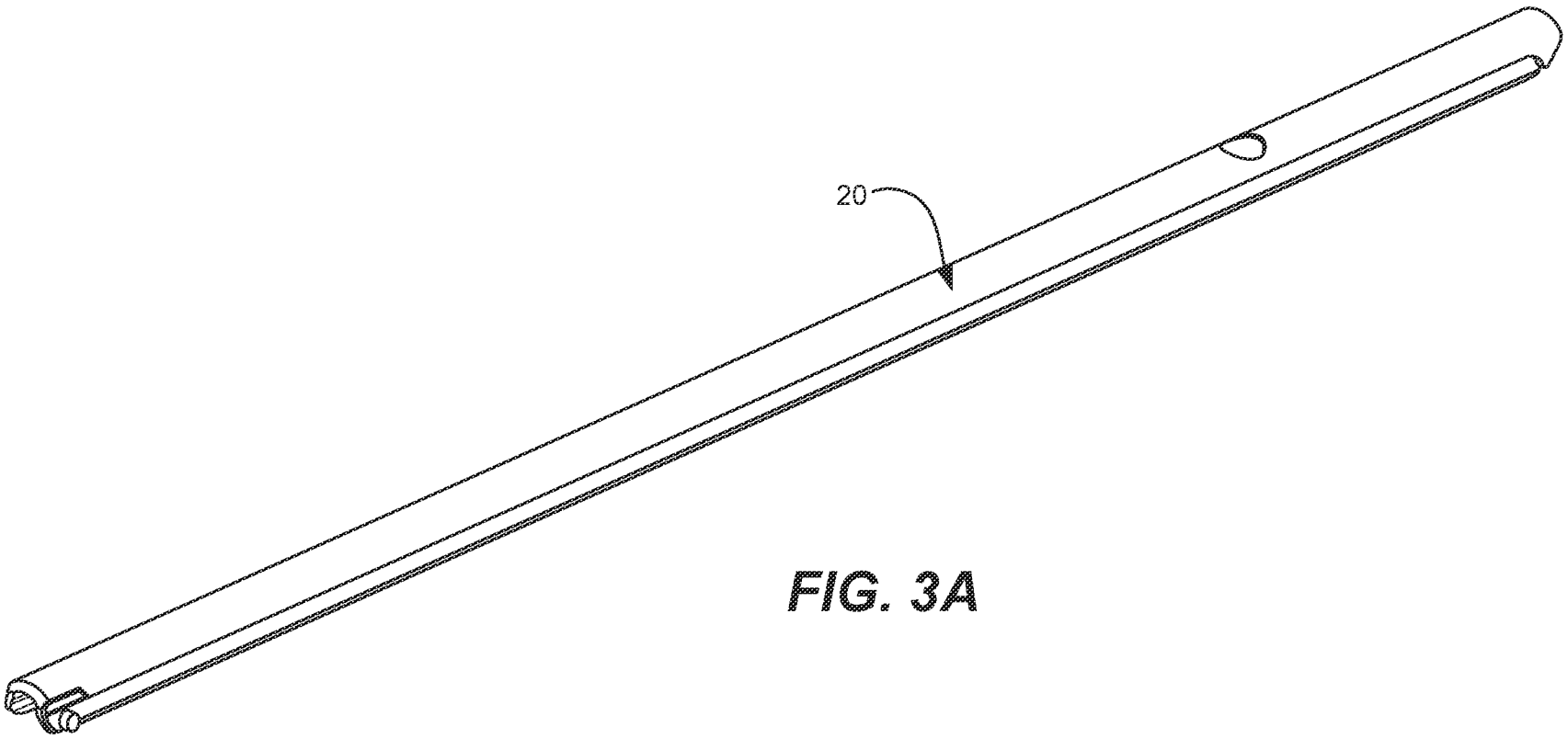
FIGS. 3A and 3B respectively are perspective views of the two straw body halves.
Figure 3B:
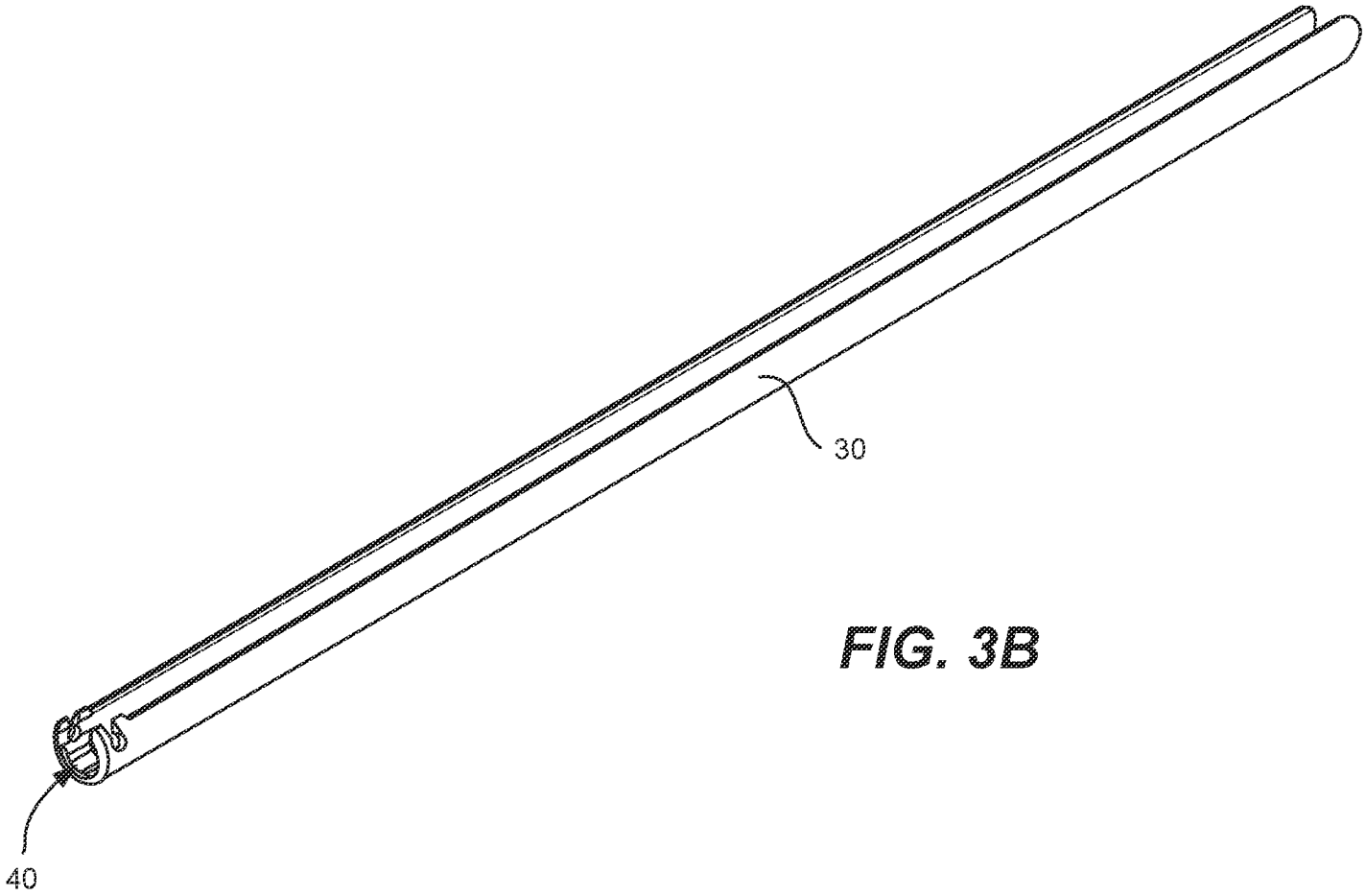
Figure 4B:
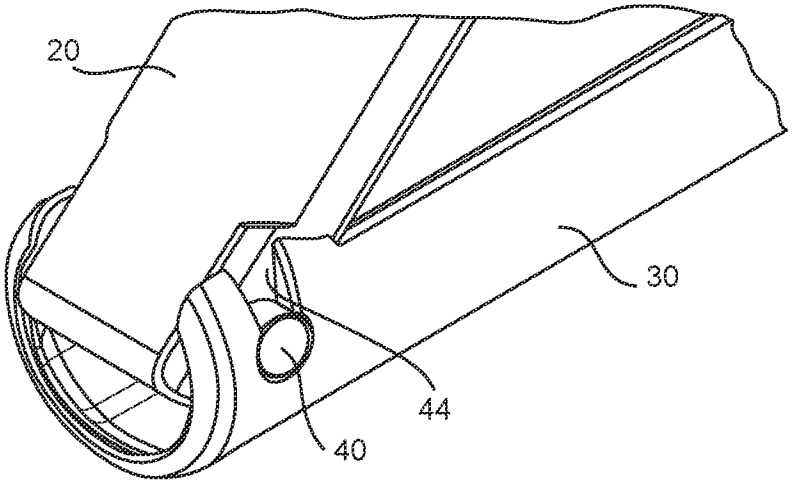
FIG. 4B is an enlarged perspective view of the pivot end of the straw 10 of FIG. 1 in a pivoted open position.
Figure 4A:
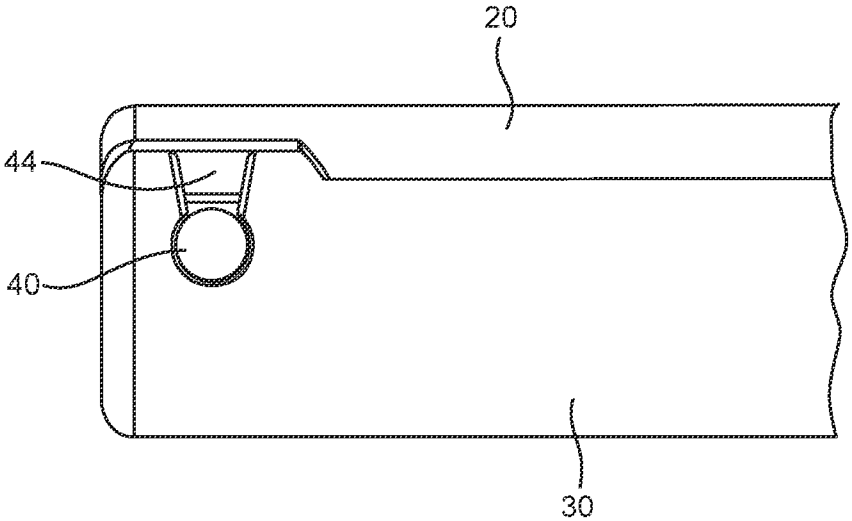
FIG. 4A is an enlarged side view of the pivot end of the straw 10 of FIG. 1 in the assembled position.
Figure 5:
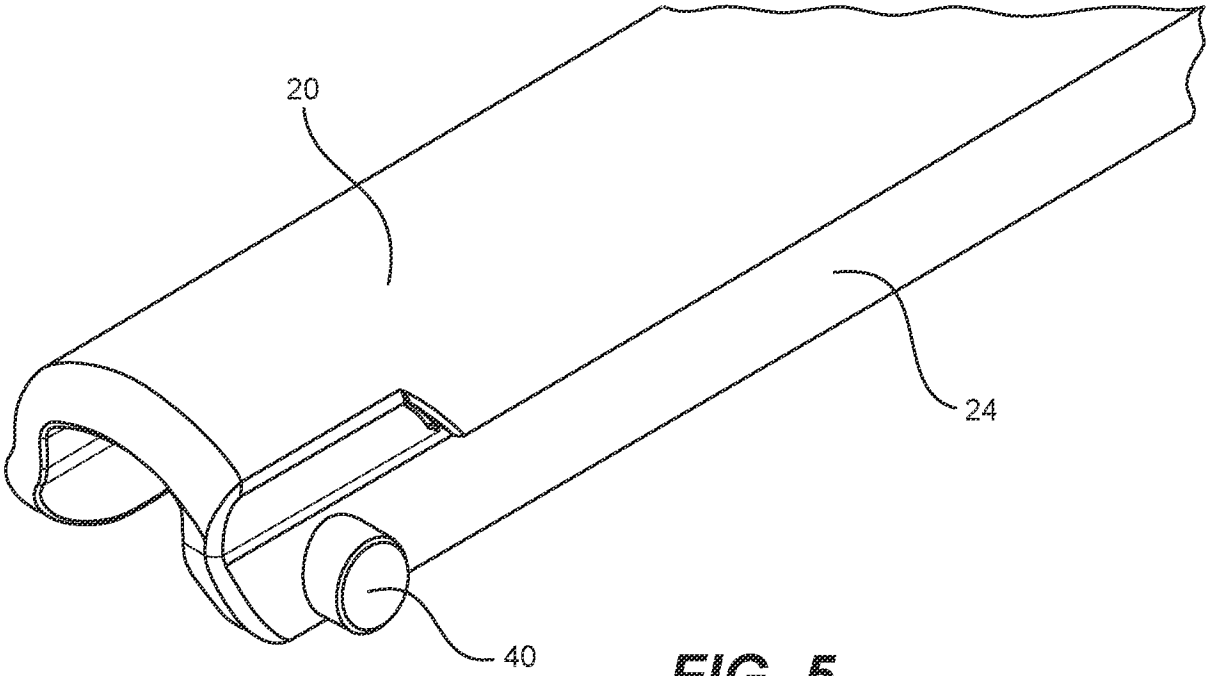
FIG. 5 is an enlarged perspective view of the pivot end of the straw body (insert channel element) 20.
Figure 6:
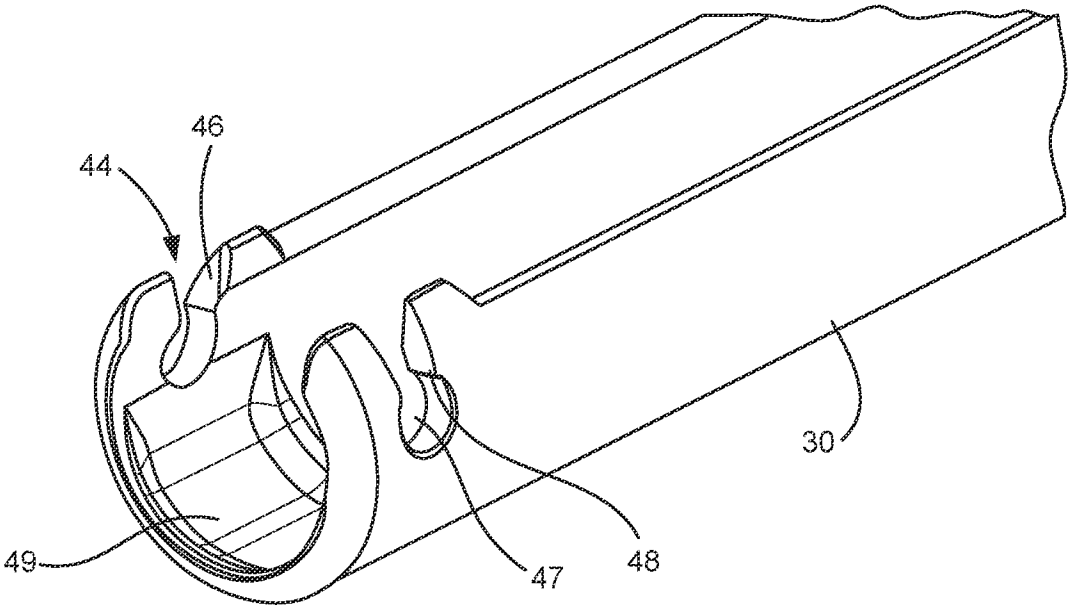
FIG. 6 is an enlarged perspective view of the pivot end of the straw body (base channel element) 30.

FIGS. 1-8C illustrate a reusable straw 10 formed in accordance with the present disclosure. The straw 10 is formed from a pair of elongated straw body elements (channel elements) 20, 30 that are can be pivotally connected on one end and joined together longitudinally to form a reusable straw as illustrated in FIG. 1A. The straw body elements 20, 30 can readily be separated while maintaining a pivotal connection between the elements as shown in FIG. 2 or completely separated apart as shown in FIGS. 3A and 3B.

As seen in FIG. 1B, base channel element 30 has a generally C-shaped cross sectional shape that defines a longitudinally extending channel 35. Both the outer and inner surfaces 31, 32 of base channel element 30 have arcuate cross-sectional shapes.

The insert channel element 20 also has a somewhat C-shaped cross section with arcuate outer and inner surfaces 21, 22 and a pair of resilient wing sections 24. The wing sections 24 of insert channel element 20 are designed to press/interference fit into base channel element 30. That is, the width between free edges 36 of the base channel element 30 is a bit narrower than the width between outer lateral edges of opposing wings 24 as best seen in FIG. 1B. Thus, the free edges 36 of base channel element must be elastically pushed apart and/or the wings 24 must be elastically pushed together in order to insert the wings 24 into channel 35. The interference fit ensures that the channel elements (sometimes referred to as straw halves) stick together during use. The geometry of the free edges 36 of the base channel element is complimentary to effective troughs at the base of wings 24 so that the straw will naturally settle in the position illustrated in FIG. 1B.

The arc defined by base channel element 30 preferably extends more than 180° and more preferably at least 200°. By way of examples, arcuate section on the order of approximately 210 to 300 degrees, as for example, about 260 degrees work well. The wing sections 24 of insert channel element 20 preferably splay outward to enhance the grip between the straw halves when the straw is assembled. The circumferentially outer sides of free edges 26 of wings 24 are preferably rounded as best seen in FIG. 1B to help guide the wings of insert channel element 20 into the channel 35 of base channel element 30 during assembly. The circumferentially inner sides of the free edges 36 of base channel element 30 are also preferably rounded to further facilitate the insertion.

Referring next to FIGS. 4A, 4B, 5 and 6, the proximal end of insert channel element 20 has a pair of aligned laterally extending hinge pins 40 that extend from opposite sides of the insert channel element. Each hinge pin 40 is configured to snap fit into a complimentary open slot 44 near the proximal end of the base channel element 30. Each slot 44 includes a tapered outer section 46 and a circular recess 47 that receives the hinge pin. During assembly, the hinge pins 40 are placed in the slots 44 and pressed past constrictions 48 into recesses 47. The snap fit is provided by the constrictions 48 which have a width that is slightly narrower than the diameter of the hinge pins 40. When the hinge pins 40 are inserted into the recess portions 47 of slots 44, the channel elements 20, 30 are pivotally connected. This pivotal connection serves to align the proximal ends of the two straw halves. This pivotal connection allows the straw halves to freely pivot relative to one another. The extent of the rotation permitted can be controlled by the geometry of the proximal ends of the channel elements. By way of example, in the illustrated embodiment, the channel elements can be pivoted approximately 180° relative to one another. This allows the straw halves to be spread out widely for easy cleaning. The embodiment illustrated in FIGS. 3B and 6 includes recess 49 on the inner surface of the bore in the vicinity of the slots 44 to permit such full rotation of the straw halves.

With the hinge pins 40 in place, the straw halves may readily be joined together to form a tubular straw by rotating the insert channel element 30 into longitudinal contact with the base channel element and then gently pressing on the inset channel element near its proximal end (but distally of the hinge) to press the wings 24 of the insert channel element into the base channel element. The user may then slide their fingers longitudinally towards the distal end while pressing gently together to thereby press the insert channel element wings 24 into place along the entire length of the straw.

During the insertion, the wings 24 elastically deform slightly inward and the free edges of the base channel element 30 elastically deform slightly outward to allow the insert channel element to slide into place. The result is a tubular straw with good structural integrity for drinking and the small elastic pressure between the wings and the adjacent walls of base channel element 30 form a good air and liquid tight seal so that the resulting straw functions very well for its intended purpose.

It should be apparent that the hinge pins 40 and slots 44 combine to serve as an alignment/registration feature that ensures that the straw halves will be precisely and properly aligned when pressed together. This helps prevent alignment errors during assembly.

Figure 7:
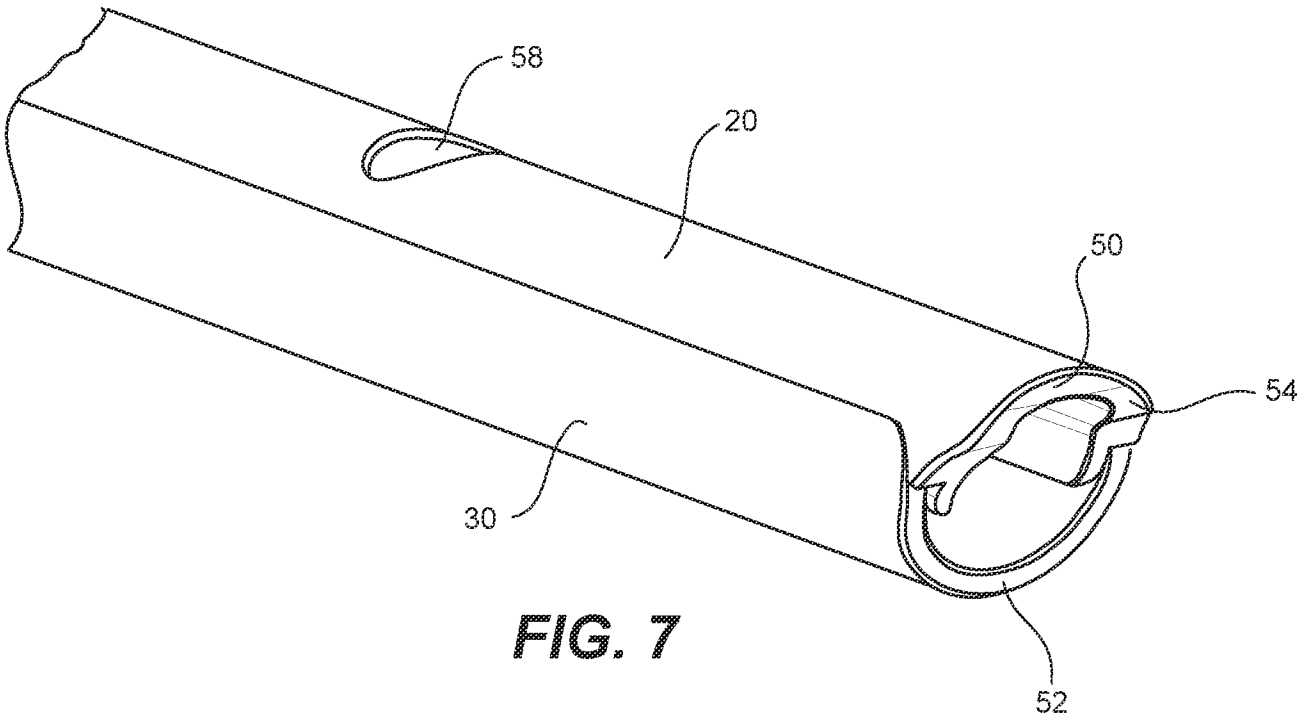
FIG. 7 is a perspective view of the distal ends of the straw 10.
Figure 8B:
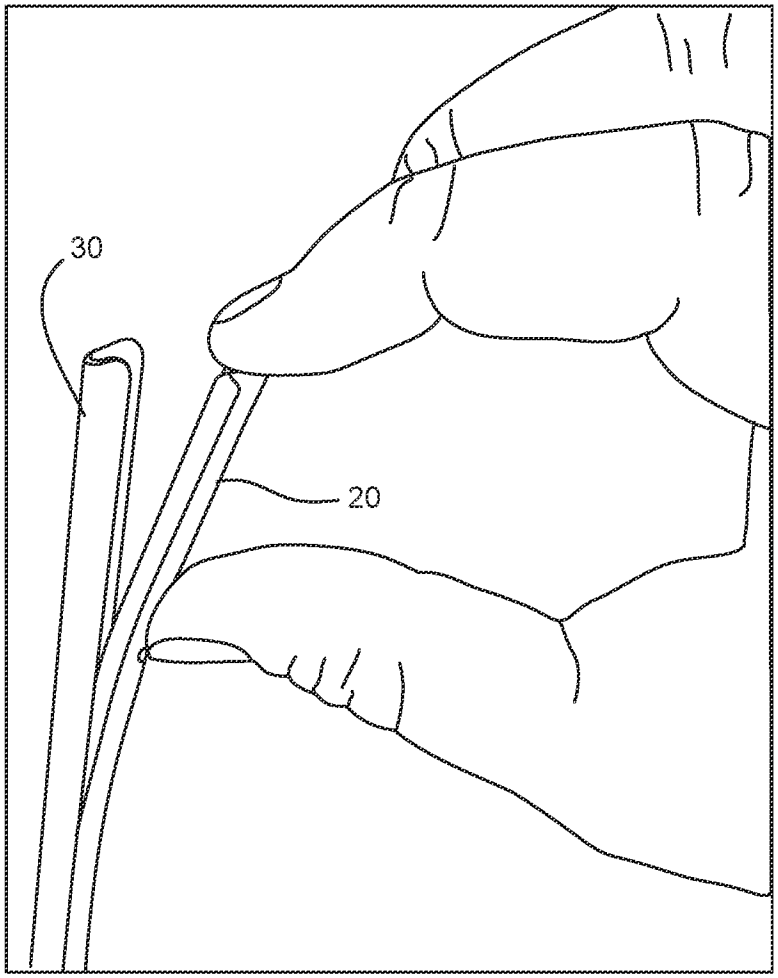
FIGS. 8A-8B illustrate a method of separating the straw body halves.
Figure 8A:
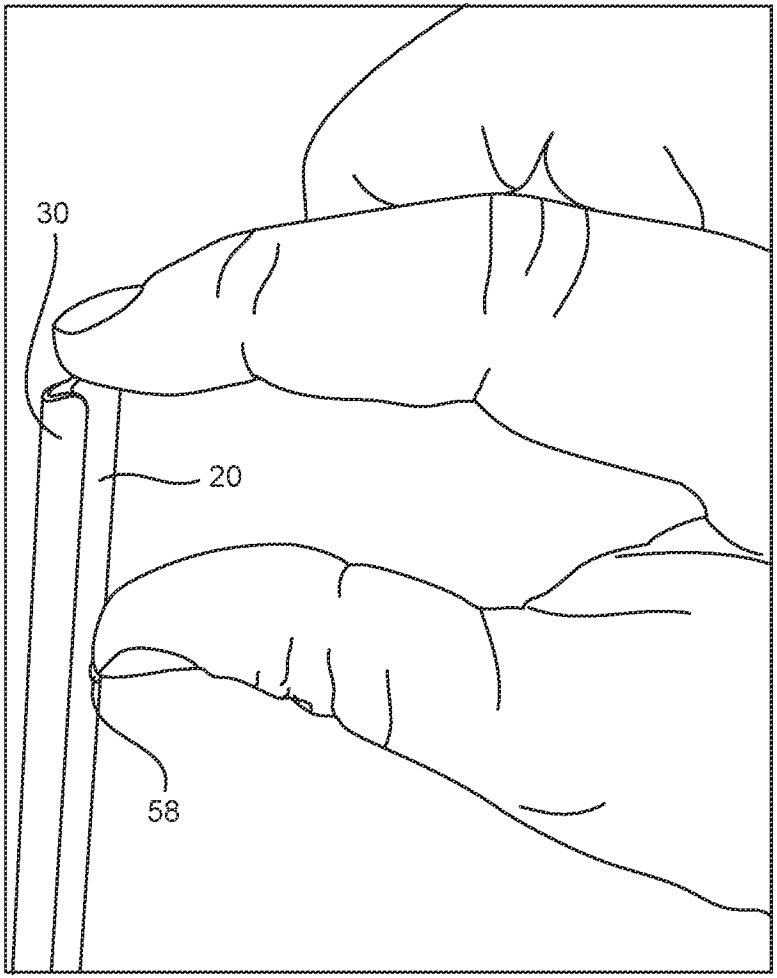

The distal end of straw 10 is illustrated in FIG. 7. As seen therein, the distal tip 50 of insert channel element 20 is tapered forward longitudinally beyond the distal tip 52 of base channel element 30. This extension provides an engagement surface 54 that a user can pull or push on to begin disassembling the straw for cleaning. In some embodiments, a small target 58 detent or marker is provided on the exterior of the insert channel element a short distance proximal of the distal tip 50. The target 58 can be used as a "pry fulcrum target." Specifically, a user may place a finger on target 58 and then pry by pushing or pulling perpendicularly (relative to the longitudinal axis) on the pull surface 54 to begin separating the halves as illustrated in FIGS. 8A-8B. Pressure on the target serves as a fulcrum that provides some mechanical advantage when prying the distal end of the insert channel element 20 from the distal end of base channel element 30. Once the distal ends are separated, the straw halves can be readily separated by simply pulling the ends laterally away from each other. When the separation is reasonably gentle, the proximal ends of the channel elements remain pivotally coupled by hinge pins 40. If complete disassembly is desired, additional force can be applied by either pulling the two halves apart or by rotating the two halves past the maximum free rotation point to pop the hinge pins 40 out of their associated slots 44 so that the straw halves are completely separated.

The exact placement of the target 58 may vary. By way of example, in some embodiments, the center of target 58 is positioned on the order of approximately 30-60 millimeters from the distal end of distal tip 50. For example, about 45 millimeters works well.

It should be apparent that the entire straw 10, including the internal bore surfaces 22, 32 can readily be washed when the straw halves are pivoted apart or completely separated. The straw 10 can be washed by hand or may be placed in a dishwasher for washing. Keeping the straw halves pivotally coupled together when placed in a dishwasher can help reduce the chance of the straw falling through the rack or utensil basket. Storing the straw in either the hinged or assembled state helps reduce the risk of inadvertently losing one of the straw halves.

The channel elements 20, 30 may be formed from a wide variety of different materials. By way of example, semi-rigid but flexible plastics like polypropylene work well. In other embodiments, the channel elements may be formed from thin flexible metals or other suitable materials.

The dimensions of the components may vary widely based on the desired overall straw geometry and the materials used. In some specific polypropylene straw embodiments, the nominal wall thickness of the channel element walls may be about 1 mm. The internal channel diameter 35 may be on the order of 5 to 9 millimeters with the preferred embodiment being 7 mm, although both wider and narrower diameter straws may be provided as appropriate for any given application. The overall length may widely vary as well.

Figure 14:
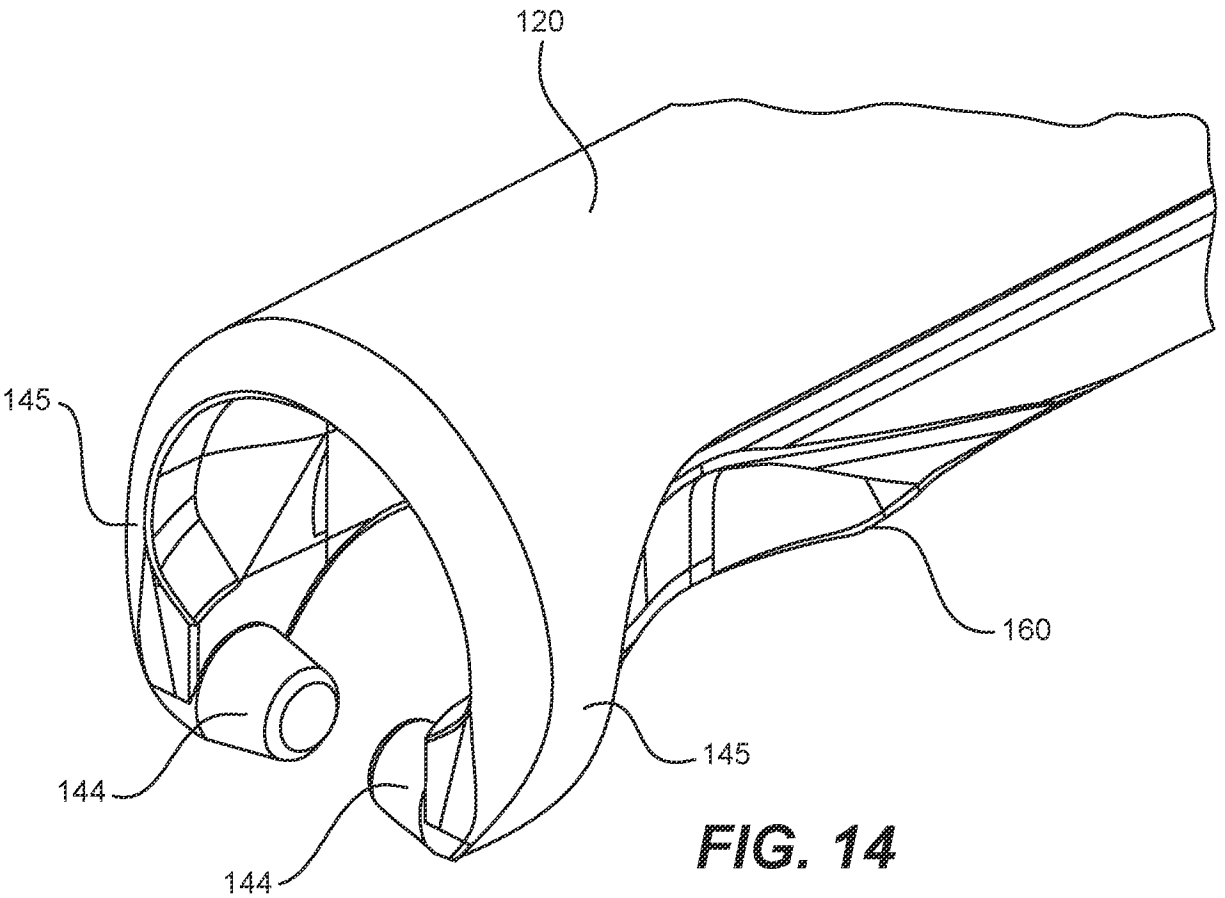
FIG. 14 is an enlarged perspective view of the pivot end of the straw body (insert channel element) 120.
Figure 15:
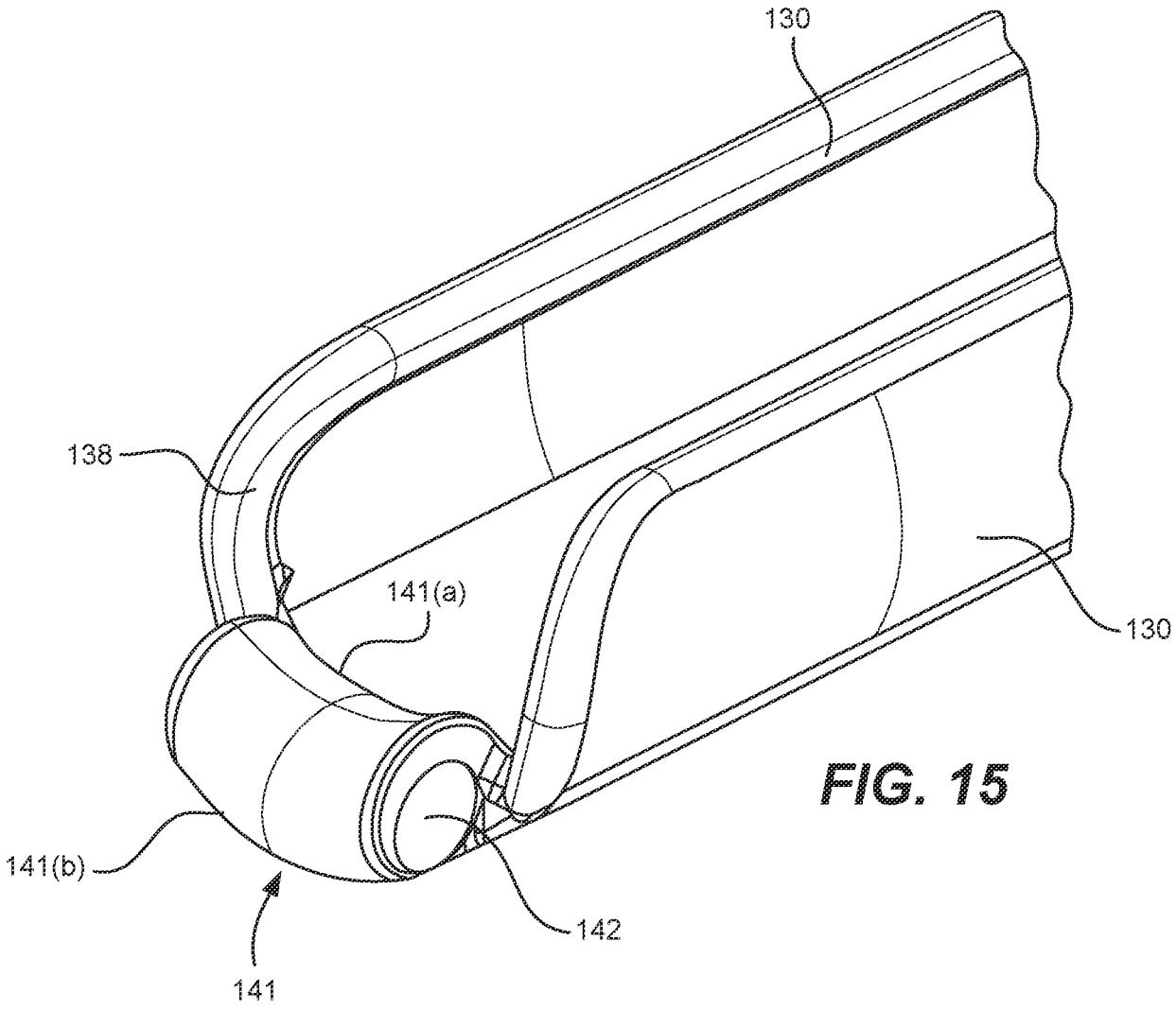
FIG. 15 is an enlarged perspective view of the pivot end of the straw body (base channel element) 130.

Referring next to FIGS. 9-17 another reusable straw embodiment will be described. Straw 110 is the same in many respects to the straw 10 illustrated in FIGS. 1-8. However, the hinge assembly 140 that pivotally joins the straw body elements 120, 130 together is somewhat different as best seen with reference to FIGS. 13A, 13B, 14, 15, 17A and 17B. Specifically, in the illustrated embodiment, the proximal end of base channel element 130 includes a center knuckle 141 having recesses 142 at opposing ends of the knuckle (FIG. 15). The proximal end of the insert channel element 120 includes a pair of tapered hinge pins 144 (FIG. 14). Each hinge pin is carried by a corresponding stanchion 145 that extend downward (from the perspective of FIGS. 9-15) from opposing walls of insert channel element 120 at the proximal end of insert channel element 120. The hinge pins 144 extend inward from their respective stanchions 145 and each is received, by an associated one of the knuckle recesses 142. Thus, in the embodiment of FIGS. 9-17, the hinge pins extend inwardly towards a center knuckle, whereas in the embodiment of FIGS. 1-6 the hinge pins extend outwardly to engage corresponding slots.

The hinge arrangement illustrated in FIGS. 9-17 has a number of features and advantages. The hinge pins 144 are generally frustoconical in shape. That is, they are tapered inwardly from the base at their corresponding stanchions towards their tips such that the diameter of the pins are narrower at their tips than at their bases. Similarly, the knuckle recesses 142 that receive the hinge pins are tapered inward in a complimentary manner. The tapering of the hinge pins serves as a centering feature that make it easier to attach the channel elements. The complementary tapering of hinge pins and knuckle recesses also serves as an ejection feature as will be discussed in more detail below. The tapering of the recesses is also more easily moldable by providing a drafted surface that can be more easily ejected with common injection molding processes.

Figure 9A:
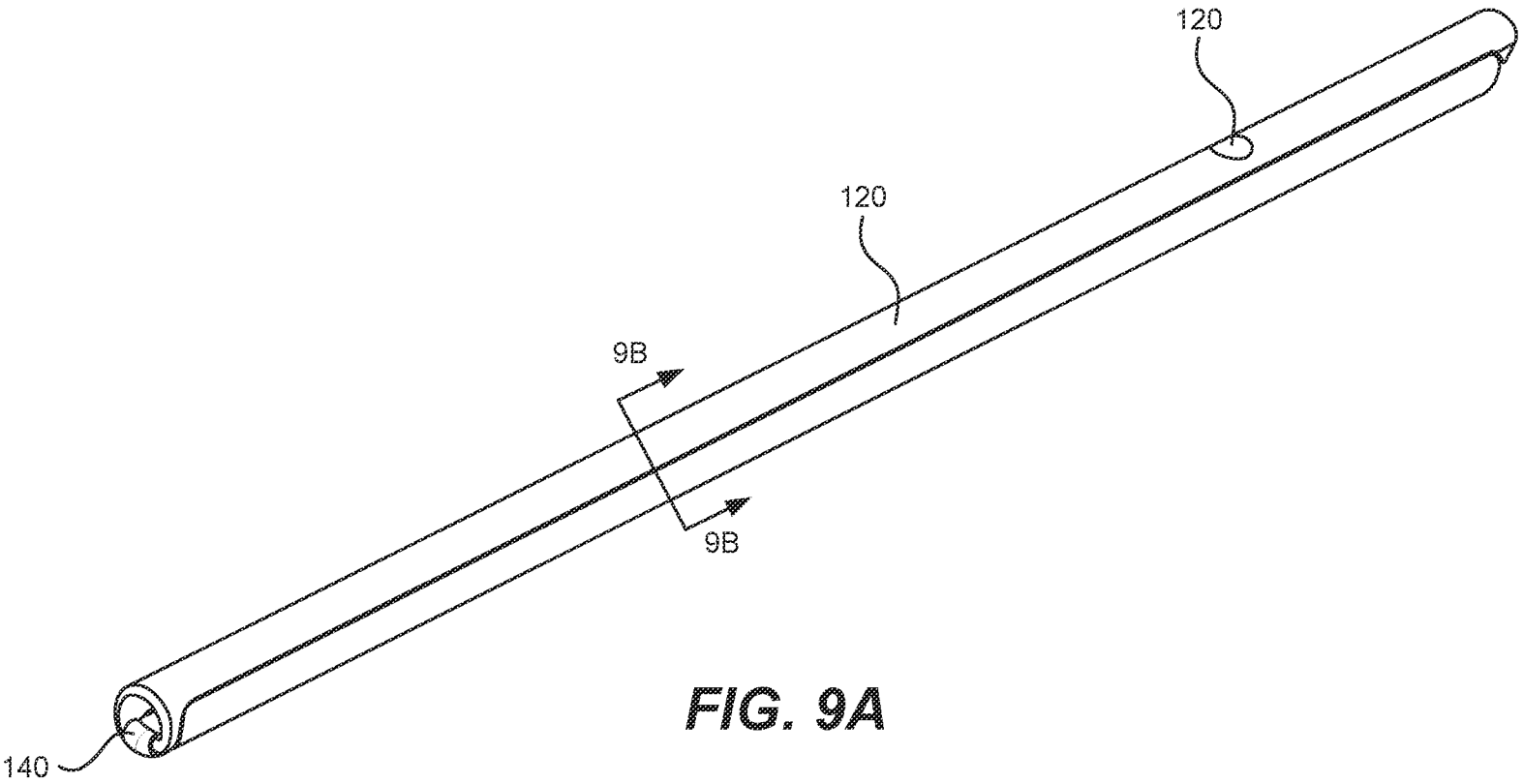
FIG. 9A is a perspective view of a straw in accordance with a second described embodiment.
Figure 16:
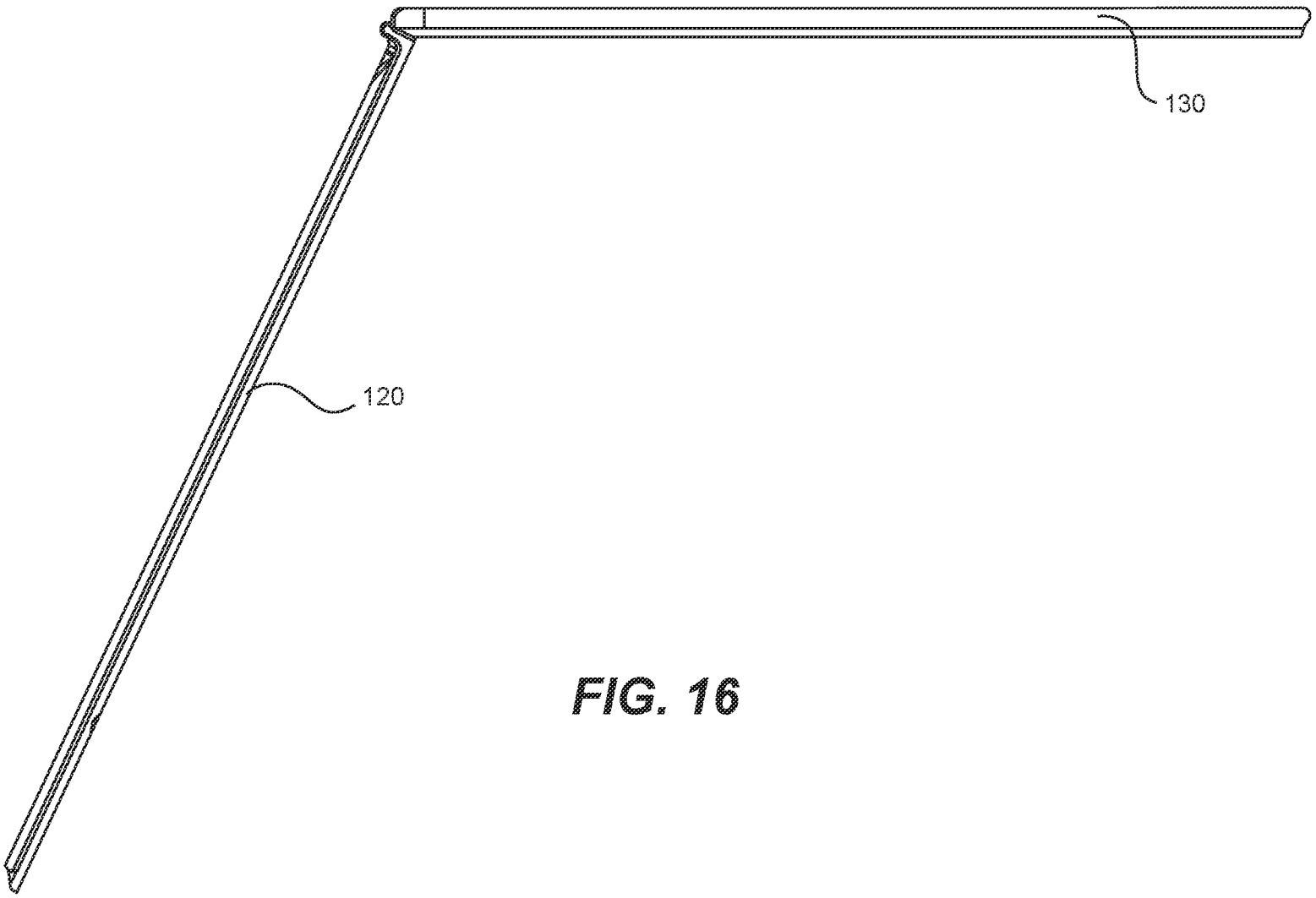
FIG. 16 is a side view of the straw of FIG. 9 showing the pivot limit of the hinge connecting the two straw body halves.

In the illustrated embodiment, the knuckle 141 has slightly arcuate inner and outer surfaces (141(*a*) and 141(*b*) respectively) as best seen in FIG. 16. The hinge assembly is positioned at the proximal end of the straw—which can be the end that a user will suck on when using the straw (although it should be appreciate that the user may drink from either end of the straw). In the illustrated embodiment, the knuckle 141 is carried at the proximal end of the base channel element 130 at a position low on the base so that it doesn't protrude too far into the straw's flow channel. However, it does protrude some into the assembled straw's flow channel. The concave curvature of the inner surface 141(*a*) reduces the amount that the hinge assembly 140 extends into the assembled straw's fluid flow path, thereby helping improve fluid flow at the proximal end of the straw. The convex curvature of the outer surface 141(*b*) of knuckle 141 helps provide a smooth feel in the mouth of the user if this end of the assembled straw is used for drinking as best seen in FIG. 9A.

The low positioning of the hinge 140 at the proximal end of the straw 110, combined with the hinge pins 144 sharing a central common axis gives the straw halves a wide range of angular motion relative to one another. For example, in the illustrated embodiment, the range of free rotational movement is well over 180 degrees as can be seen in FIG. 16. In general, ranges of rotational freedom in the range of 210 to 270 degrees are readily attainable. In the illustrated embodiment, the range of free motion is on the order of 250 degrees. If/when, the hinge rotates far enough, the stanchions 145 will eventually come into contact with the straw walls at the proximal end of the base channel element 130 adjacent the hinge knuckle 141 (e.g., at the position illustrated in FIG. 16). From that point of contact, further rotation causes the stanchions 145 to begin splaying slightly apart, thereby moving the hinge pins 144 outward. That is, the stanchions are pushed apart by the proximal end of base channel element 130. If the hinge is rotated far enough, the hinge pins 144 will pop out of the knuckle recesses, thereby separating the straw halves 120, 130. The complementary tapering of hinge pins and the knuckle recesses 142 helps facilitate a smooth ejection of the hinge pins from the knuckle recesses in the described manner. It should be appreciated that by selecting the relative geometries of the hinge 141, the stanchions 145 and the proximal ends of the straw halves, a convenient, "built-in" ejection mechanism can be provided which makes it very simple to separate the straw halves with minimal effort.

Another benefit of the hinge arrangement is that, when desired, the straw can readily be cleaned with the straw halves pivoted apart, but still coupled together. It should be apparent that the straw can be cleaned by hand, by dishwasher or in other desired manners as previously discussed. The wide range of motion facilitated by the hinge allows the straw halves to be pivoted far apart (e.g., 180 degrees or more) to facilitate washing—when desired.

Conversely, the straw halves can also be easily reattached together. This can be done either by simply pressing the hinge pins against the knuckle. The frustro-conical shape of the hinge pins and the curved outer surface of the knuckle incline to spread the stanchions apart so the hinge pins go around the knuckle and then into the recesses. Alternately, the user can place one hinge pin in one recess and then press the second hinge pin onto the knuckle to spread the second stanchion apart until the second hinge pin can snap into the associated knuckle recess.

In the illustrated embodiment, the straw halves 120, 130 also have a sealing feature that helps seal the joint between the straw halves when the straw is assembled. The sealing feature will be described with reference to the cross-sectional view of the straw shown in FIG. 9B. Much like the previously described embodiment, the insert channel element 120 has an arcuate wall section 123 and a pair of resilient wing sections 124. A small longitudinally extending trough 125 is formed at the base of the exterior side of each wing 124. The troughs 125 are each sized to receive a corresponding free edge 136 of the base channel element 130. The geometry of the free edges 36 of the base channel element are complimentary to the troughs 125 at the base of wings 124 so that the straw will naturally settle in the position illustrated in FIG. 9B.

The base channel element 130 is substantially C-shaped in cross section. Similarly, to the previously described embodiments, the wing sections 124 of insert channel element 120 are designed to press/interference fit into arcuate wall section 123 of base channel element 130. The interference fit ensures that the channel elements stick together during use. As previously described, the width between free edges 136 of the base channel element 130 is a bit narrower than the width between outer lateral edges of opposing wings 124 to provide the press/interference fit. Thus, the free edges 136 of base channel element must be elastically pushed apart and/or the wings 124 must be elastically pushed together in order to insert the wings 124 into channel 135. The interference fit ensures that the channel elements stick together during use.

Figure 9B:
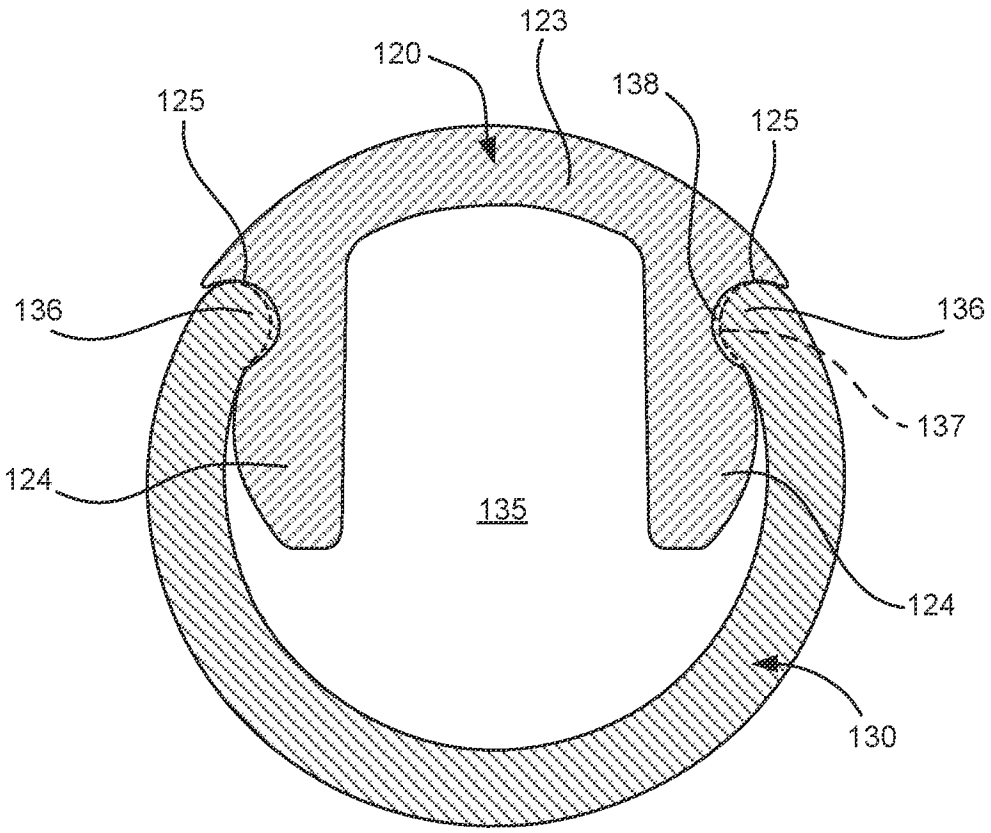
FIG. 9B is a cross sectional view of the straw 110 of FIG. 9A taken along line 9B-9B.
Figure 10:
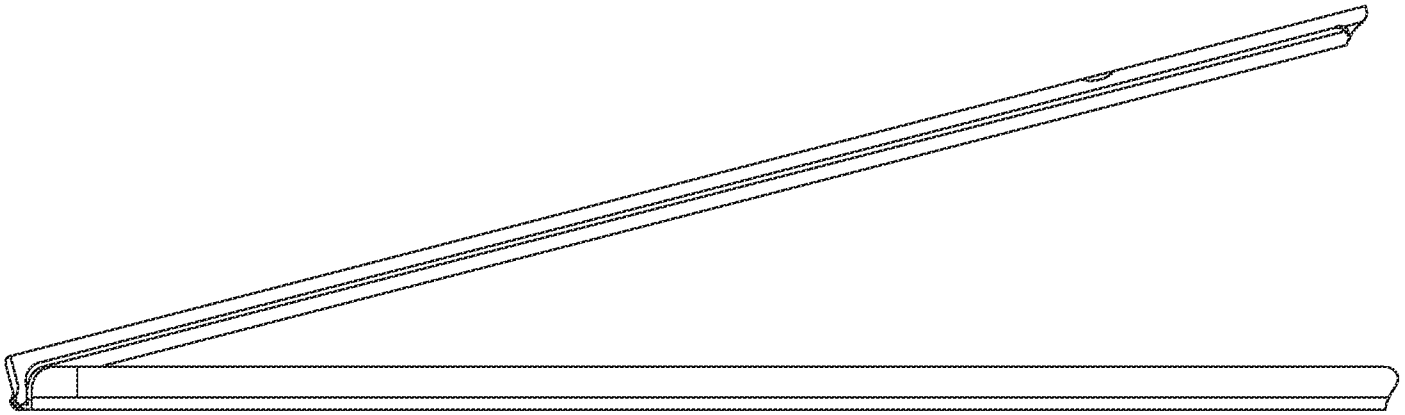
FIG. 10 is a side view of the straw 110 of FIG. 9 with its two halves in a pivoted open position.
Figure 11:
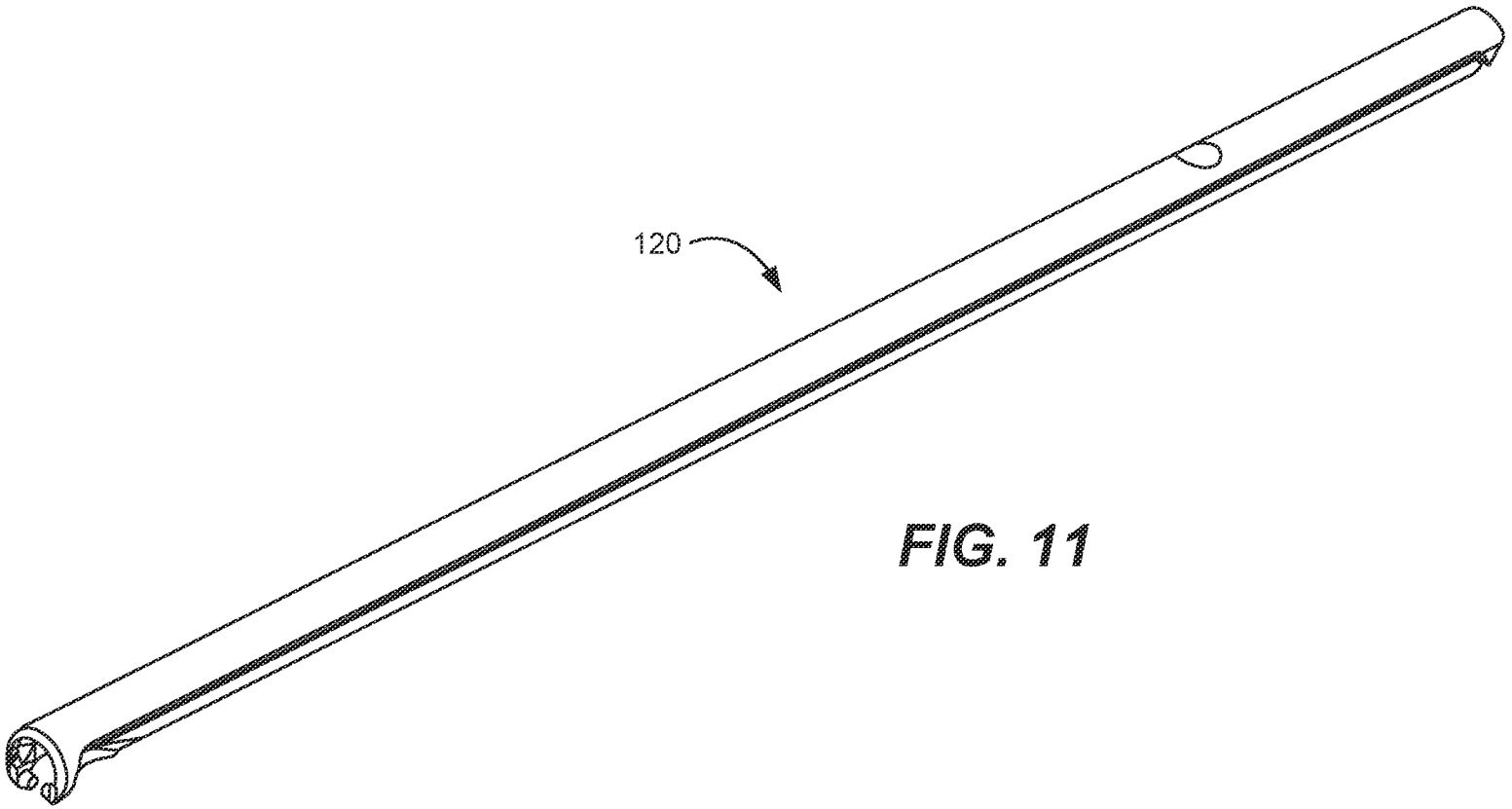
FIG. 11 is a perspective view of the straw body half (insert channel element) 120 of the straw 110 of FIG. 9.
Figure 12:
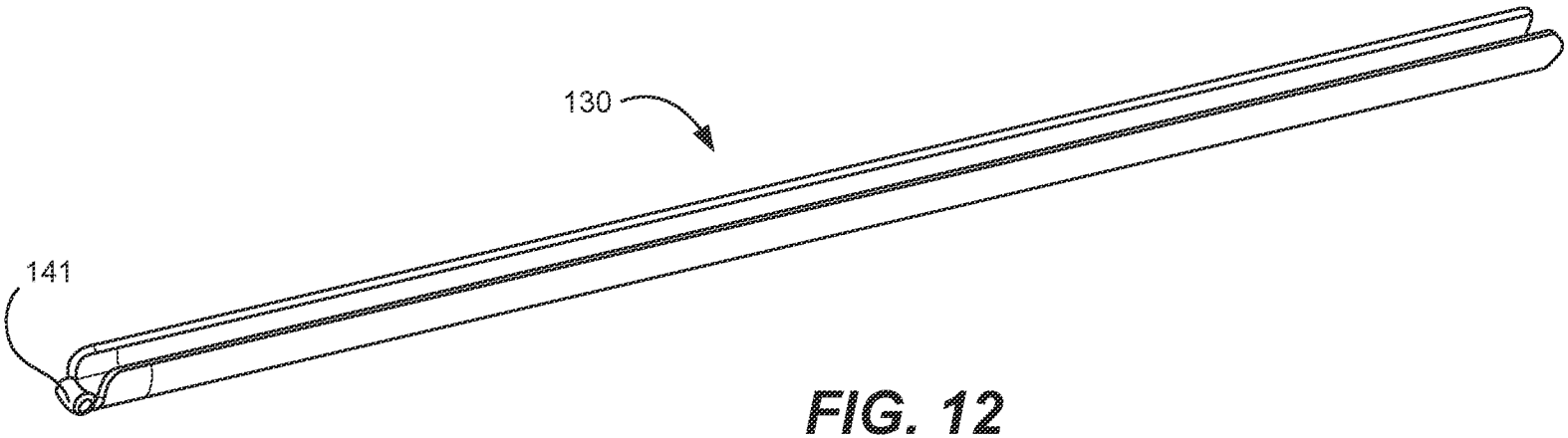
FIG. 12 is a perspective view of the straw body half (base channel element) 130 of the straw 110 of FIG. 9.
Figure 13B:
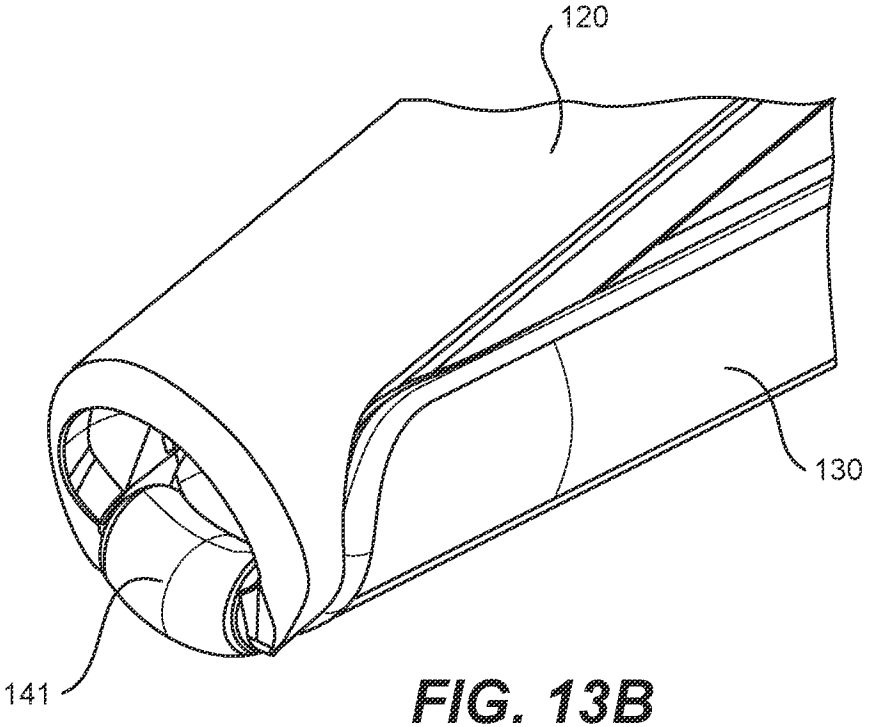
FIG. 13B is an enlarged perspective view of the pivot end of the straw 110 of FIG. 9 in a pivoted open position.
Figure 13A:
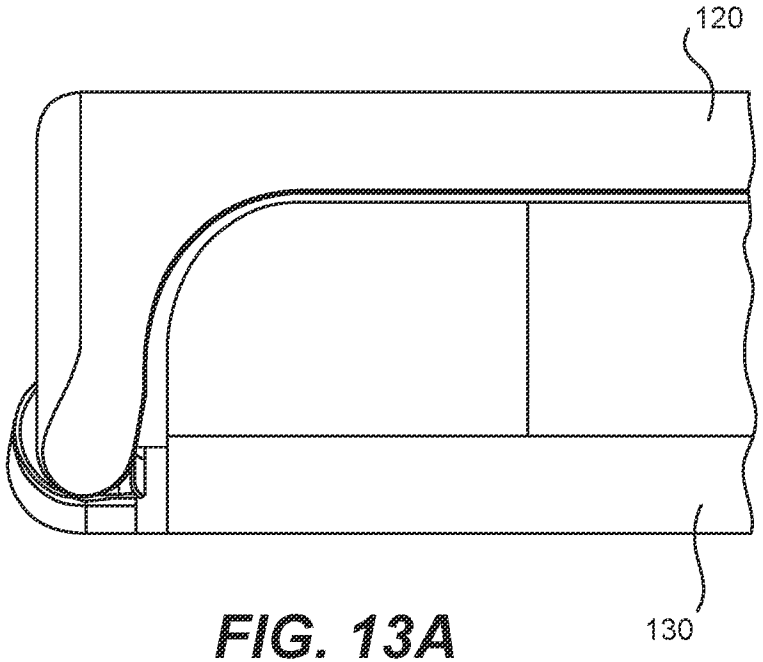
FIG. 13A is an enlarged side view of the pivot end of the straw 110 of FIG. 9 in the assembled position.
Figure 13C:
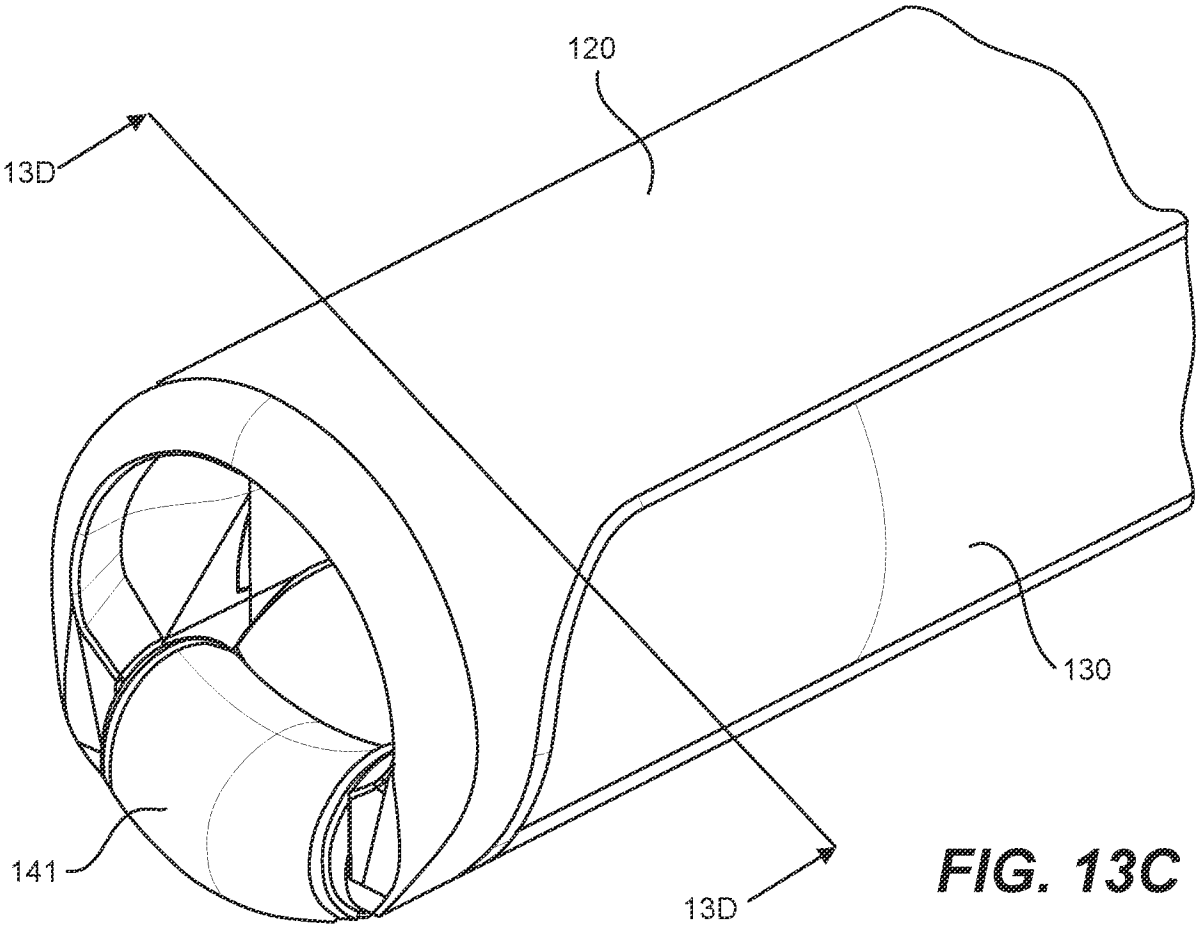
FIG. 13C is an enlarged perspective view of the pivot end of the straw 110 of FIG. 9 in an assembled (useable straw) position.
Figure 13D:
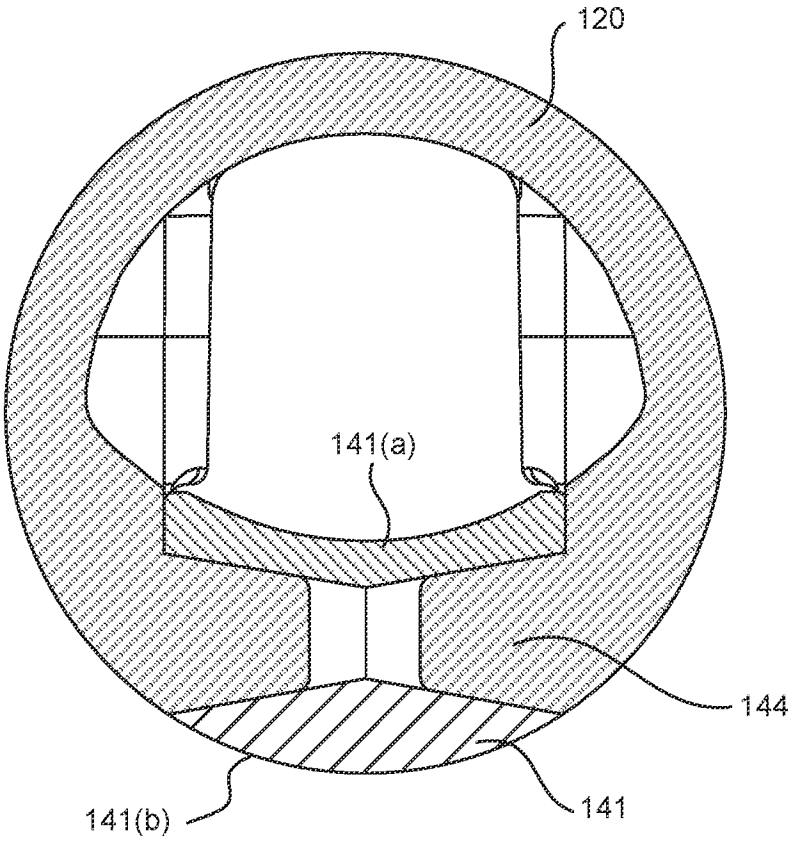
FIG. 13D is a cross section taken along line 13D-13D of FIG. 13C.

In FIG. 9B a dashed line 137 is shown at each of the free edges 135 of the wall 131 of base channel element 130. The dashed line is intended to show what the geometry of the free edges would be if they were to match exactly with the troughs 125 into which they are inserted. However, as can be seen, the free edges 136 have additional materials. That is, they are slightly overbuild relative to what they would be to make a perfect fit. Since both straw halves are made from resilient materials, this "extra" material causes the free edges 135 to apply a pressure against the trough walls, thereby forming a good seal between the straw halves (i.e., between the free edges 135 of base channel element 130 and the wall of troughs 125 of insert channel element 120). In the illustrated embodiment, the extra material takes the form of a longitudinally extending lip 138 that has a bit larger width than the remainder of the wall 131. The illustrated sealing arrangement has been found to provide a particularly good seal between the straw halves that is resistant to creep over time that would otherwise reduce the efficacy of the seal. It is pointed out that creep can be a particular problem when plastic straws are washed in high temperature settings as is common with automatic dishwashers. The lips 138 (and thus the troughs/free edge interference fit sealing) preferably extends the entire overlapping length of the of the straw portions so that a good seal is formed along the entire length of the straw. Additionally, the lip may extend along the proximal end of the base channel element to the vicinity of hinge knuckle 141 as best seen in FIG. 15. The troughs 125 may extend along the distal sides of the stanchions 145 in a complimentary manner as best seen in FIG. 17B.

Like the previously described embodiment, the proximal end of insert channel element 120 may also include a recess/depression 149 on the inner surface of the bore. In this embodiment, the recess 149 serves to increase cross sectional area of the fluid flow path at the proximal end of the straw relative to what it would be with a constant width wall 123. This additional fluid flow area helps offset the flow path constriction caused by hinge knuckle 141 thereby improving the fluid flow when drinking.

The straw may optionally include a catch feature that can be used to hold the straw halves in a designated splayed position when desired. This can be particularly useful when the straw is placed in a dishwasher for cleaning or on a rack for drying. Preferably the catch feature is structurally sound enough to comfortably hold the straw halves in the splayed position, but flexible enough so that the straw halves may be readily rotated through the holding point when either joining or separating the straw halves.

Figure 17A:
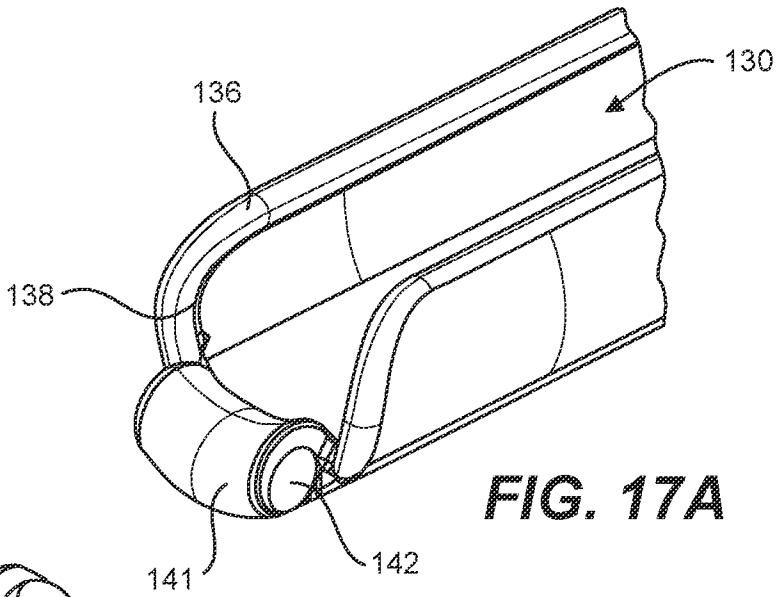
FIGS. 17A and 17B are a perspective view of the proximal ends of the straw body halves of FIG. 9 in a separated arrangement.
Figure 17B:
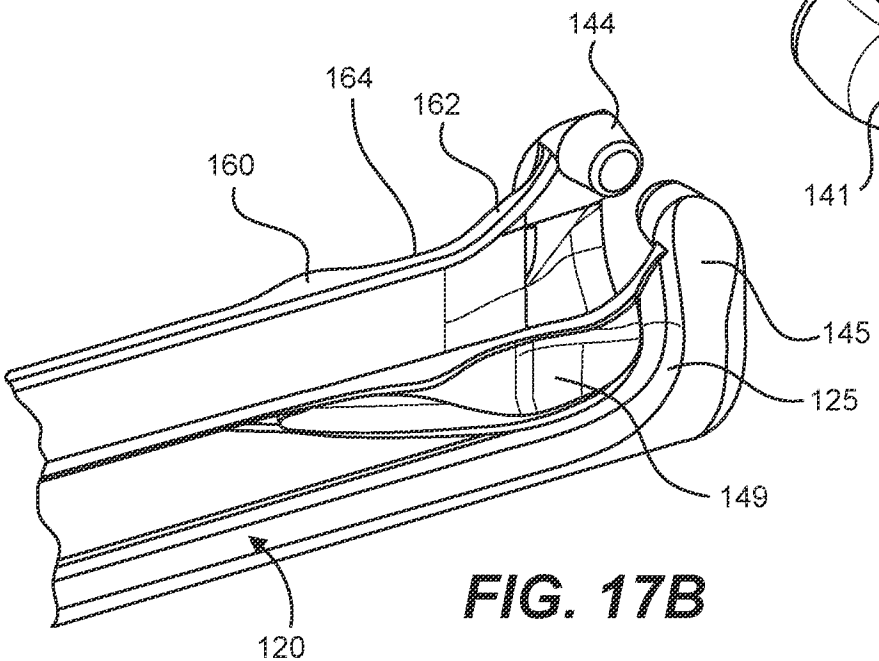

Referring next to FIGS. 14 and 17, one suitable catch feature will be described. In the illustrated embodiment, small exterior protrusions 160 and 162 are provided on the outer side of one of the insert channel element wings 124 slightly distal of the hinge pin as best seen in FIG. 17B. As the insert channel element 120 is rotated towards the assembled straw position the more proximal protrusion 162 will come into contact with an adjacent portion of the lip 138 on one of the free edges 136 of base channel element 130 flexing the adjacent portion of the associated free edge slightly outward. The protrusion 160 is spaced distally a bit apart from the protrusion 162 with a narrower section 164 located therebetween. As the insert channel element 120 is further rotated relative to the base channel element 130, the portion of the lip trying to enter trough 125 will advance distally first past the narrower section 164 between protrusions 160 and 162 and then past the more distal protrusion 160. The elasticity of free edges 136 of the base channel element 130 keeps the free edges in contact with the contour of the outer walls of the insert channel element through this rotation. When the lip "passes over" the more distal protrusion 160, the protrusion causes the adjacent portions of the free edges to splay slightly further apart as the contacting portion of lip 138 passes the protrusion relative to the splaying that occurs when passing over the narrower section 164. The combination of the narrow section 164 between the protrusions 160, 162 effectively forms a "catch feature" that will hold the straw halves in a stable splayed position. The splay angle between the straw halves can be set by selecting/defining the relative positions of the protrusion and narrow section, and the "strength" or "holding power" of the catch feature can be set to a certain extent by selecting/defining the size and geometry of the respective components.

Although the catch feature has been described in the context of protrusions on one of the insert channel wings, it should be appreciated that the desired contours can be provided in any desired manner and may be provided on either one or both sides of the insert channel element. For example, the feature 162 may readily be integrated into the stanchion design and indeed that is the case in the illustrated embodiment as best seen in FIG. 17B. The specific "catch angle" that is provided may vary in accordance with the design goals. By way of example, catch splay angles on the order of 10-20 degrees are believed to work well for many applications, with a catch splay angle in the range of 14 to 15 degrees being used in some embodiments. Such angles provide a relatively compact open position that works well for dishwasher cleaning and drying. For example, the straw splayed into its stable position is easily place in a utensil tray or other suitable portions of a dishwasher and is open enough to have virtually all of the surfaces exposed for cleaning.

The described straw may be formed from a variety of materials. By way of example, Polypropylene (PP) or Polyoxymethylene (POM) work well. However, in other embodiments, a variety of other common injection-molded plastic resins such as Polycarbonate, Acetal, etc. can be used.

Although only a few embodiments of the invention have been described in detail, the invention may be implemented in many other forms without departing from the spirit or scope of the invention. For example, specific materials and dimensions have been described. Although (where applicable) such materials and dimensions are well suited for use in any of the described embodiments, it should be appreciated that in other embodiments, other materials and or sizes may be used/provide. Also, a number of features have been described. It should be appreciated that selected features may be added or eliminated to various embodiments. Therefore, the present embodiments should be considered illustrative and not restrictive, and the invention is not to be limited to the details given herein, but may be modified within the scope and equivalents of the appended claims. The described straw has a number of advantages relative to traditional reusable straws. The described straw is easier to clean than traditional straws and does not require a special brush to clean. The removably-attachable rotational pivot of the described straw also makes the straw easier to assemble and disassemble than other two piece straws and helps prevent the two pieces from being lost or misplaced during cleaning.

What is claimed is:

1. A straw comprising:

a longitudinally extending first straw body element having an arcuate wall that defines a longitudinally extending channel;

a longitudinally extending second straw body element having an arcuate outer wall portion and a pair of resilient wings, wherein the wings are configured to extend into the first straw body element channel when the straw is in an assembled position, and wherein a seal is formed between the first and second straw body elements when the straw is in the assembled position; and a hinge that pivotally couples the first straw body element to the second straw body element at a first longitudinal end of the of the straw such that the first and second straw body elements can be pivoted between the assembled position in which the straw may be used for drinking, and a splayed position that facilitates washing the first and second straw body elements, wherein the hinge is releasable and reattachable such that the first straw body element can be separated from and reattached to the second straw body element, whereby the first and second straw body elements are independent of one another and not attached together by the hinge when separated; and wherein the hinge includes a pair of hinge pins on one of the first and second straw body elements that are received in corresponding slots on the other of the first and second straw body elements, and the hinge is configured such that the hinge pins will pop out of their corresponding slots to thereby separate the first and second straw body elements when the first and second straw body elements are pivoted relative to one another beyond a designated rotational release position.

2. A straw as recited in claim 1 wherein the seal is formed between free edges of the first straw body element wall and the second straw body element.

3. A straw as recited in claim 1 further comprising a catch element configured to hold the first and second straw body elements in a stable intermediate splayed position, the stable intermediate splayed position being a position that is between the assembled position and a full rotational extent to which the first and second straw body elements can be rotated relative to one another.

4. A straw comprising:

a longitudinally extending first straw body element having an arcuate wall that defines a longitudinally extending channel;

a longitudinally extending second straw body element having an arcuate outer wall portion and a pair of resilient wings, wherein the wings are configured to extend into the first straw body element channel when the straw is in an assembled position, and wherein a seal is formed between the first and second straw body elements when the straw is in the assembled position; and a hinge that pivotally couples the first straw body element to the second straw body element at a first longitudinal end of the of the straw such that the first and second straw body elements can be pivoted between the assembled position in which the straw may be used for drinking, and a splayed position that facilitates washing the straw body elements, and wherein the hinge includes a knuckle integrally formed with, and of the same material as, the first straw body element at a proximal end of the first straw body element, and a pair of hinge pins integrally formed with, and of the same material as, the second straw body element at a proximal end of the second straw body element.

5. A straw as recited in claim 4 wherein the second straw body element further comprises a pair of stanchions integrally formed with the second straw body element at the proximal end of the second straw body element, each stanchion carrying an associated one of the hinge pins.

6. A straw as recited in claim 4 wherein the hinge pins are substantially frusto-conical in shape.

7. A straw as recited in claim 5 wherein:

the hinge has an axis of rotation; and the hinge and stanchions are configured to cause the hinge pins to be ejected from the knuckle when the first and second straw body elements are pivotally rotated sufficiently relative to one another about the hinge's axis of rotation.

8. A straw as recited in claim 1 wherein the hinge is configured to permit at least 180 degrees of pivotal rotation.

9. A straw as recited in claim 8 wherein the hinge is configured to permit at least 210 degrees of pivotal rotation between the first and second straw body elements.

10. A straw as recited in claim 1 wherein:

a distal end of the second straw body element extends beyond a distal end of the first straw body element to thereby provide a pry engagement surface;

the second straw body element includes a visible target; and wherein a user can initiate separation of the first and second straw body elements by pushing or pulling outwardly on the pry engagement surface while pushing inwardly on the target.

11. A straw as recited in claim 1 wherein the first straw body element has a substantially C-shaped cross section having an arc length of at least 200 degrees.

12. A straw as recited in claim 11 wherein the arc length of the first straw body element is in the range of 210 to 300 degrees.

13. A straw comprising:

a longitudinally extending first straw body element having an arcuate wall that defines a longitudinally extending channel;

a longitudinally extending second straw body element having an arcuate outer wall portion and a pair of resilient wings, wherein when the wings are configured to extend into the first straw body element channel when the straw is in an assembled position, and wherein a seal is formed between the first and second straw body elements when the straw is in the assembled position; and a hinge that pivotally couples the first straw body element to the second straw body element at a first longitudinal end of the of the straw such that the first and second straw body elements can be pivoted between the assembled position in which the straw may be used for drinking, and a splayed position that facilitates washing the first and second straw body elements, wherein the hinge is configured to permit at least 180 degrees of pivotal rotation and is releasable such that the first straw body element can be separated from the second straw body element, whereby the first and second straw body elements are free and independent of one another and not attached together by the hinge when separated, and wherein the hinge includes a knuckle integrally formed with, and of the same material as, the first straw body element at a proximal end of the first straw body element, and a pair of hinge pins integrally formed with, and of the same material as, the second straw body element at a proximal end of the second straw body element; and a catch element configured to hold the first and second straw body elements in a stable intermediate splayed position, the stable intermediate splayed position being a position that is between the assembled position and a full rotational extent to which the first and second straw body elements can be rotated relative to one another.

14. A straw as recited in claim 13 wherein:

the hinge has an axis of rotation;

the second straw body element further comprises a pair of stanchions integrally formed with the second straw body element at the proximal end of the second straw body element, each stanchion carrying an associated one of the hinge pins; and the hinge and stanchions are configured to cause the hinge pins to be ejected from the knuckle when the first and second straw body elements are pivotally rotated sufficiently relative to one another about the hinge's axis of rotation.

15. A straw comprising first and second longitudinally extending straw body elements configured to be longitudinally joined together side-by-side in a sealed configuration to facilitate drinking and configured to be at least one of separable or pivoted apart to facilitate washing the straw, wherein:

a distal end of the second straw body element extends beyond a distal end of the first straw body element to thereby provide a pry engagement surface;

the second straw body element includes a visible target on an exterior surface of the second straw body, the visible target being positioned in the range of 30-60 millimeters from the distal end of the second straw body element; and a hinge that pivotally couples the first straw body element to the second straw body element at a first longitudinal end of the of the straw such that the first and second straw body elements can be pivoted between the assembled position in which the straw may be used for drinking, and a splayed position that facilitates washing the straw body elements, wherein the hinge includes a knuckle integrally formed with, and of the same material as, the first straw body element at a proximal end of the first straw body element, and a pair of hinge pins integrally formed with, and of the same material as, the second straw body element at a proximal end of the second straw body element; and wherein a user can initiate lateral separation of the first and second straw body elements by pushing or pulling outwardly on the pry engagement surface while pushing inwardly on the target.

16. A straw as recited in claim 15 wherein the target is or includes one of a recess, a protrusion or a marking.

17. A straw as recited in claim 1 wherein the designated rotational release position is greater than 180 degrees of rotation from the assembled position.

* * * * *